United States Patent [19]

Skeem

[11] Patent Number: 5,050,344

[45] Date of Patent: Sep. 24, 1991

[54] GATE OPENING DEVICE

[76] Inventor: Wayne B. Skeem, 1742 Targhee, Twin Falls, Id. 83301

[21] Appl. No.: 330,623

[22] Filed: Mar. 30, 1989

[51] Int. Cl.[5] ..... E05F 1/04

[52] U.S. Cl. ..... 49/237; 49/245; 49/280

[58] Field of Search ..... 49/237, 238, 245, 240, 49/258, 254, 255, 280

[56] References Cited

U.S. PATENT DOCUMENTS

| | | | |
|---|---|---|---|
| 587,847 | 8/1897 | Morris | 49/238 |
| 989,878 | 4/1911 | Sandborg | 49/238 |
| 1,609,369 | 12/1926 | Laird | 49/237 |
| 3,820,282 | 6/1974 | Kornylak | 49/255 |
| 3,888,045 | 6/1975 | Piegza | 49/255 |

FOREIGN PATENT DOCUMENTS

| | | | |
|---|---|---|---|
| 393963 | 7/1933 | United Kingdom | 49/237 |

*Primary Examiner*—Philip C. Kannan
*Attorney, Agent, or Firm*—Scott McNees

[57] ABSTRACT

An automatic gate opening device is provided which simultaneously lifts and opens the gate. A drive mechanism forces the gate upward, while a roller bearing following a helical slot in a tube causes rotation of the gate. Hinges are provided which allow simultaneous rotational and linear displacement of the gate.

3 Claims, 3 Drawing Sheets

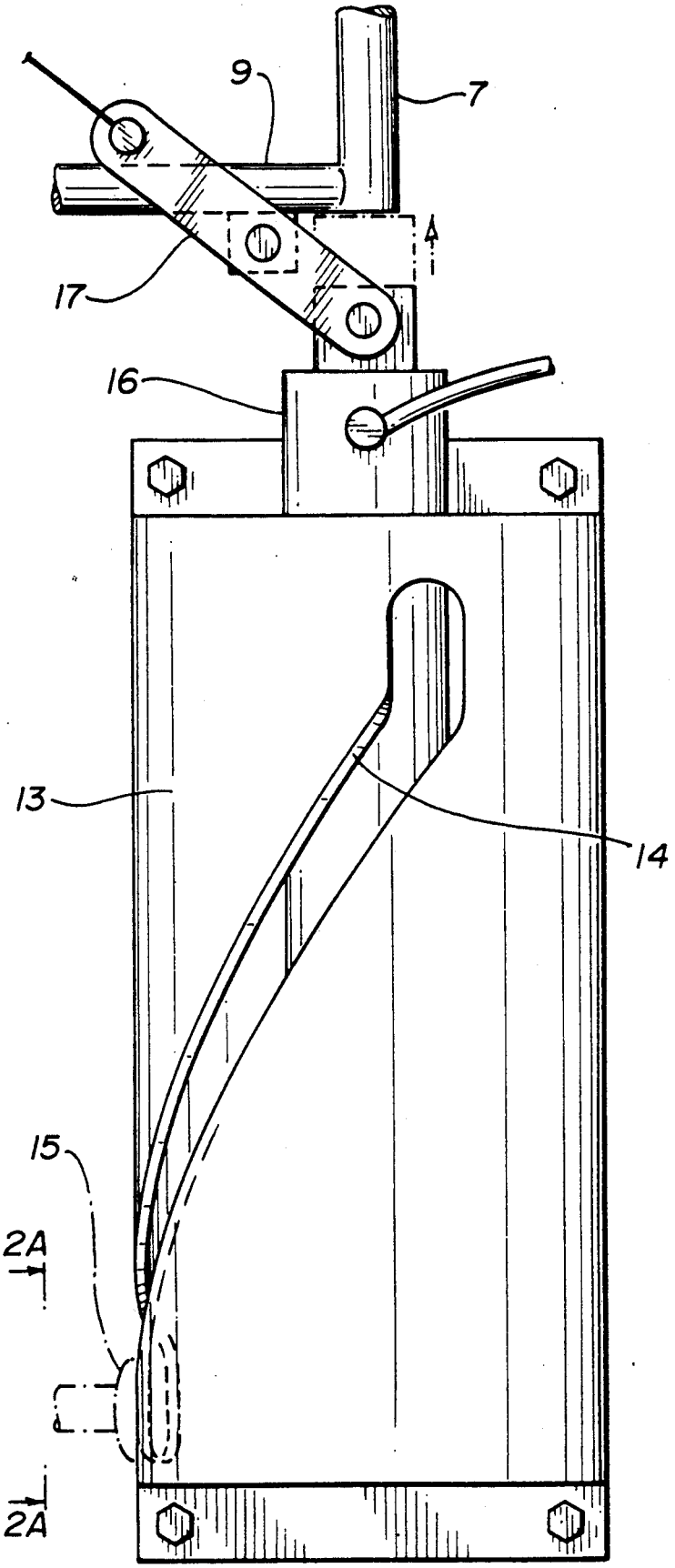
FIG-2
FIG-2A
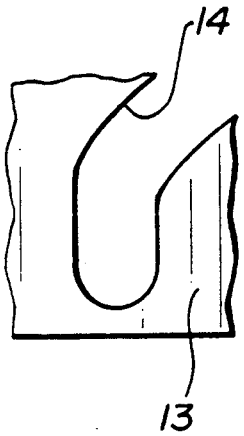

GATE OPENING DEVICE

BACKGROUND OF THE INVENTION

This invention relates generally to powered gate openers and, particularly, to powered gate openers which provide vertical lift to the gate as it is opened. Various gate openers are known which provide for vertical lifting of a gate in conjunction with the opening of the gate.

U.S. Pat. No. 4,667,440 discloses a gate opener having a gate post with two vertically spaced helical slots through the walls of the post, a slidable and rotatable spindle concentrically located inside the gate post, two L-shaped pins attached to the spindle and extending outwardly through the slots and attached to a gate, and a power drive which moves the spindle vertically.

U.S. Pat. No. 4,458,448 discloses a gate opener comprising a gate post with helical guides attached thereto and rollers attached to the gate which follow the helical guides and causes the gate to swing open it is lifted vertically.

U.S. Pat. No. 4,285,165 discloses a gate having a support roller which moves along a stationary cam track to effect the vertical lifting of the gate as it swings open.

U.S. Pat. No. 2,925,674 discloses a gate with hinges extending through helical cam slots in a gate post and attached to a shaft. When the shaft is raised by a treadle, the hinges follow the helical cam slots, causing the gate to swing open.

U.S. Pat. No. 2,086,061 discloses a gate having a roller guide which follows a helical cam, causing the gate to rise as it is pushed open.

None of the previously known gate openers comprise a tube attached to the gate post having a helical slot therein, a follower for following the slot, and hinges which allow for both rotational and linear movement of the gate.

SUMMARY AND OBJECT OF THE INVENTION

The present invention provides a gate opening device for lifting a gate vertically while simultaneously swinging the gate open. A gate is mounted to a gate post by means of special hinges which allow for linear displacement of the gate as well as rotational displacement. A tube having a slot extending longitudinally and axially in the cylindrical surface of the tube is mounted to the gate post. A follower means is attached to the gate and engages the slot. A fluid actuated drive means is provided for causing upward motion of the gate. As the gate is forced upward, the follower means follows the slot longitudinally and axially about the tube, causing the gate to rotate to the open position simultaneously with the upward displacement.

It is an object of the present invention to provide an automatic gate opening device which simultaneously lifts and opens a gate. It is also an object of the invention to provide such a gate opener which may be easily mounted into a gate post.

BRIEF DESCRIPTION OF THE FIGURES

FIG. 2 is an expansion of the area enclosed by the dotted line in FIG. 1, showing the relationship between the drive cylinder and hinge.

DETAILED DESCRIPTION OF THE INVENTION

Figure 1:
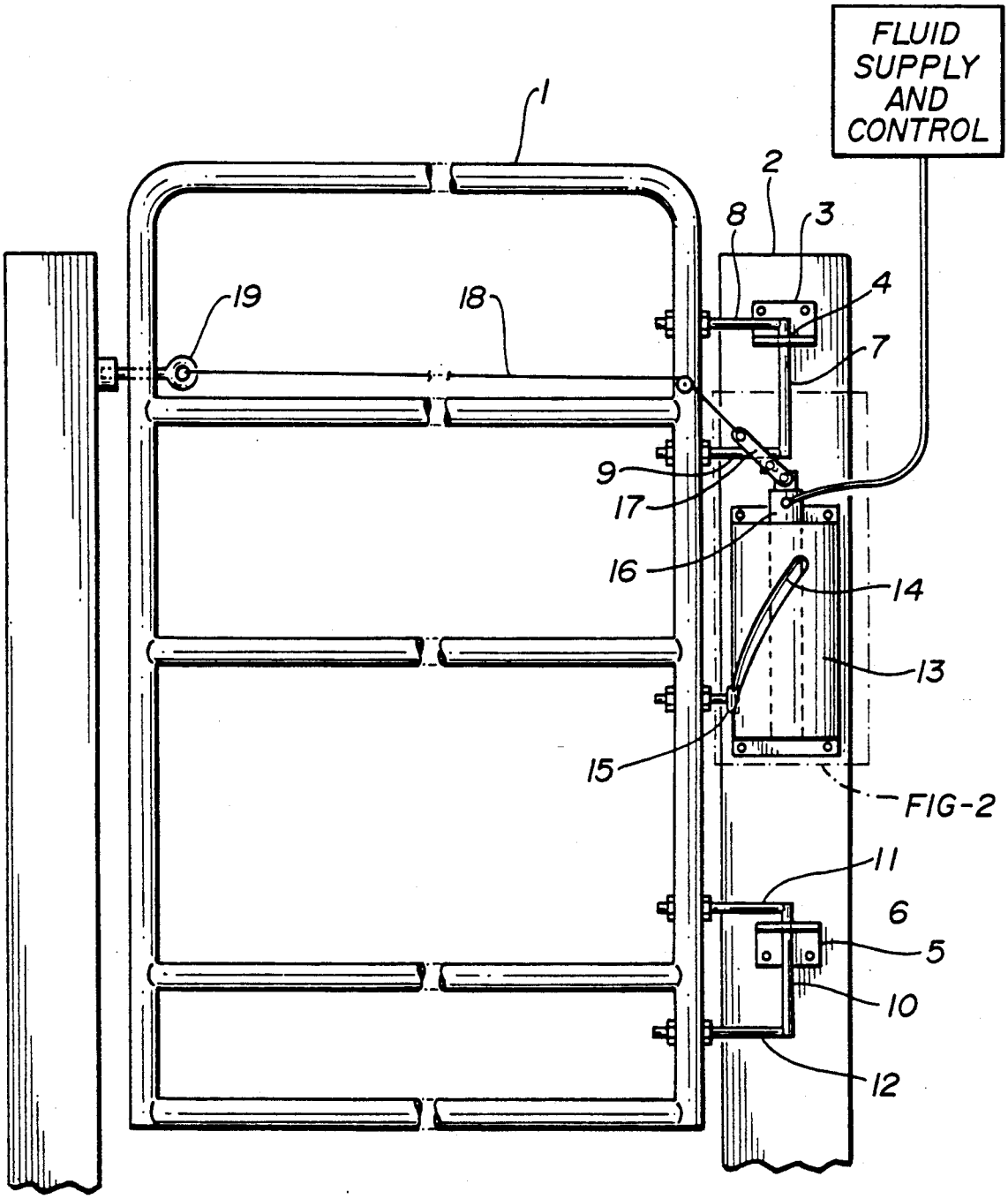
FIG. 1 is an elevation showing the gate opening device mounted on a gate post.
Figure 3:
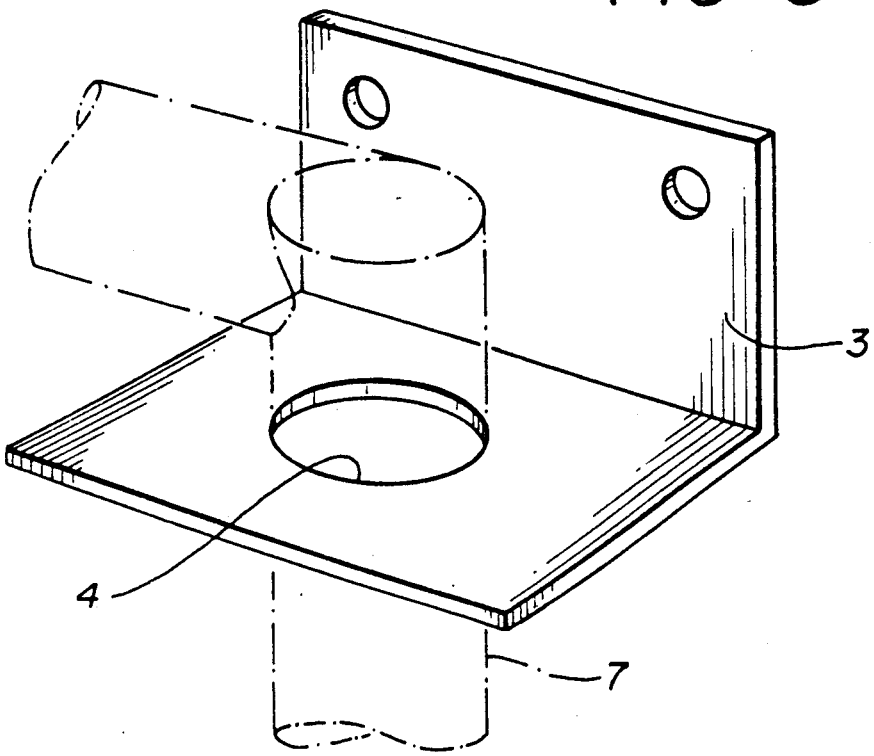
FIG. 3 shows an embodiment of a hinge comprising an angle bracket with a hole.
Figure 4:
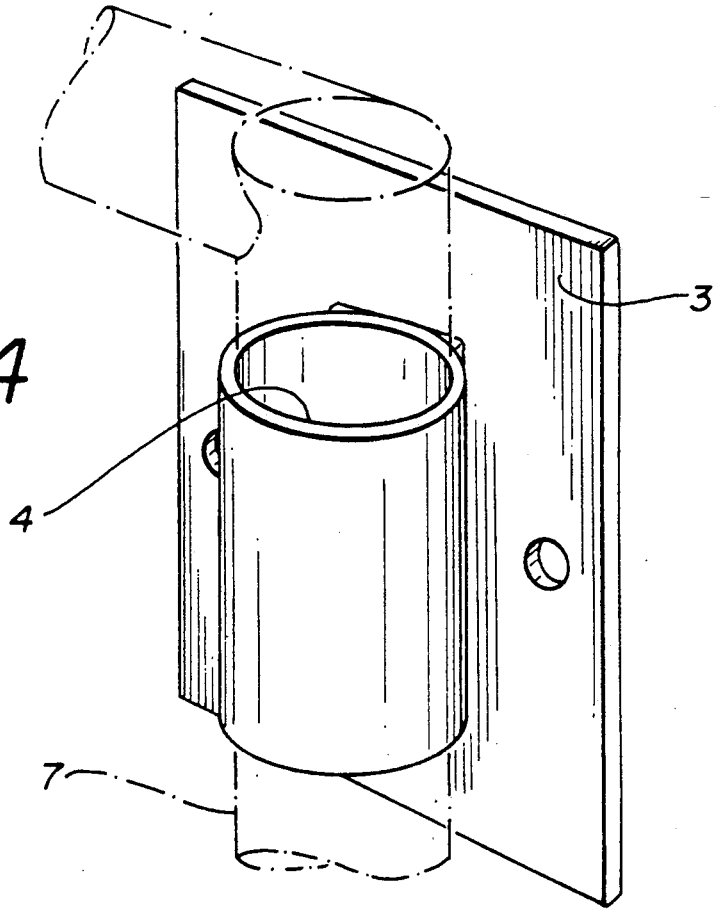
FIG. 4 shows an embodiment of a hinge comprising a sleeve or bushing.

The invention described below is generally shown in FIG. 1. A gate 1 is mounted to a gate post 2 by means of hinges. Each of the hinges comprises a plate 3, 5 formed as an angle bracket mounted on the gate post 2 and a hinge element 7, 10 attached to the gate. Each plate 3, 5 has a circular aperture 4, 6 oriented in the horizontal portion of the angle bracket. In the embodiment shown in FIG. 3, each plate 3, 5 has a horizontal portion with a hole therein. In another embodiment, shown in FIG. 4, the plate may have attached to it a tube, sleeve, or bushing. The hinge element 7, 10 attached to the gate comprises an elongated portion which is slidably disposed within the respective aperture 4, 6 on the plate 3, 5. The ends of the elongated portions of the hinge elements 7, 10 are connected to the gate by means of horizontal portions 8, 9, 11, 12 which are fixed to the gate by suitable fasteners. In an alternative embodiment of the invention, the plate having the aperture may be connected to the gate and the hinge element may be connected to the gate post. The linear hinge arrangement described above allows, in addition to rotation of the gate about the hinges, a linear displacement of the gate, which is accomplished by the ability of the elongated hinge element 7, 10 to slide within the aperture 4, 6.

A cylindrical or tubular element is attached to the gate post. In the embodiment of FIG. 1, a tube 13 is attached to the gate post 2 between the upper and lower hinge elements 7, 10. The longitudinal axis of the tube 13 is oriented vertically. The tube 13 is provided with a slot 14 that extends both longitudinally and axially in the wall of the tube 13 preferrably in a helical pattern. A follower means 15 for following the slot in the tube 13 is attached to the gate and engages the slot 14. In a preferred embodiment, the follower means comprises a ball or roller bearing that engages the slot 14.

A drive mechanism 16 is mounted on the gate post. In a preferred embodiment, the drive mechanism is disposed within the tube and has a ram arranged just below the bottom edge of the upper hinge element 7. Alternatively, the drive mechanism 16 may be disposed just below the lower hinge element 10. The drive mechanism 16 may be a fluid actuated drive cylinder such as a hydraulic or pneumatic cylinder, or a mechanical device such as a screw jack. In a preferred embodiment, a commercially available air cylinder having a diameter of two or two-and-a-half inches and a stroke of ten inches, available from Clippard Instrumentation Laboratories, Cincinnati, Ohio, is utilized. The air cylinder is driven by an Intercompressor TM air compressor available from KP Industries, Minneapolis, Minn. The compressor is controlled by an acoustically actuated relay incorporated into solid state circuitry which provides the voltage necessary to power the compressor. Such a control device is available from KWM Electronics, Salt Lake City, Utah. The cylinder 16 is mounted on the gate post slightly below the lower portion of the top hinge element 7. When the cylinder 16 is actuated, the ram extends so that the end of the ram abuts the lower end of the upper hinge element, thereby exerting an upward vertical force and driving the hinge element upward. As the air cylinder is extended, the gate is forced vertically upward. The distance of vertical travel is determined by the extendable length of the cylinder and the length of the elongated portion of the hinge elements 7, 10. In a preferred embodiment, the gate moves vertically upward a distance of approximately ten inches. As the gate is forced upward by the air cylinder 16, the bearing 15 engaging the slot 14 follows the slot 14 effecting a rotational movement of the gate by which the gate is opened. The distance of axial rotation of the gate is determined by the axial length of the slot 14 in the tube 13. In the preferred embodiment, the slot 14 extends approximately 90°–95° around the circumference of the tube, thus providing for a 90°–95° rotation of the gate from the closed position to the open position. The control mechanism which actuates the air cylinder is provided with a timer, not shown, which determines the duration of activation of the compressor. In a gate opener utilizing a screw jack as the drive mechanism, the extent of opening of the gate is determined by a limit switch. After the gate has been opened, air is purged from the air cylinder. As the air pressure is released, gravity forces the gate to descend vertically. As the gate descends, the bearing 15 engaging the slot 14 causes the gate to rotate to the closed position.

The gate opening device of the present invention may also be provided with a latch pin release mechanism. In a preferred embodiment, such a mechanism comprises a lever arm 17 which is pivotally attached to the horizontal portion 9 of the upper hinge element as shown in FIGS. 1 and 2. One end of the lever arm 17 is pivotally attached to the end of the air cylinder 16, and the other end of the lever arm 17 is attached to a cable 18 or other linkage which links the lever arm 17 to a spring-loaded latch pin 19. As the air cylinder 16 is actuated, the initial extension of the air cylinder 16 causes a pivoting of the lever arm 17 thereby putting tension on the cable 18 and thus releasing the latch pin 19. In the preferred embodiment, the air cylinder 16 is attached to the gate post so that the end of the ram is disposed approximately one inch below the upper hinge element 7. When the air cylinder 16 is actuated, the initial approximately one inch of travel effects a release of the latch pin 19, before the air cylinder abuts the upper hinge element 7 and exerts the vertical force by which the gate is lifted and opened. The upper hinge element 7 may be adapted for the pivotal attachment of the lever arm 17.

In an alternative embodiment of the invention, the lower terminal portion of the helical slot 14 may extend substantially longitudinally. Such a slot allows the gate to be initially lifted vertically without rotation for a distance determining by the length of the substantially longitudinal portion of the slot 14.

What is claimed is:

1. A gate opening device for mounting on a vertical gate post comprising:

(a) first and second hinges each comprising a plate attached to the gate post and having a circular opening in a horizontal plane, and a hinge element having an elongated portion slidably disposed within the circular opening and horizontal portions connecting the ends of the elongated portion to a gate, said first hinge being mounted to the gate post above said second hinge;

(b) a tube having a helical slot therein attached to the gate post and oriented vertically between the first and second hinges;

(c) a bearing element attached to the gate and engaging the helical slot in the tube;

(d) an extendable drive mechanism vertically disposed within the tube below the first hinge element such that when the drive mechanism is extended, the drive mechanism abuts the upper hinge element and exerts a vertical force on the upper hinge element.

2. A gate opening device of claim 1, further comprising a latch pin release mechanism which comprises a lever arm having two ends and being pivotally attached between the ends to the first hinge, one end being pivotally attached to the drive mechanism and the other end being attached to the cable linking the lever arm to a latch pin.

3. A gate opening device of claim 1, wherein a terminal portion of the helical slot extends substantially longitudinally.

* * * * *